US006073520A

United States Patent [19]

Bueno et al.

[11] Patent Number: 6,073,520

[45] Date of Patent: Jun. 13, 2000

[54] WRENCH FOR REMOVING DAMAGED STUD BOLTS

[76] Inventors: Jorge L Bueno, 8191 NW. 98 Ter.; Jesus Lopez, 8191 NW. 98 La., both of Hialeah Garden, Fla. 33016

[21] Appl. No.: 09/169,430

[22] Filed: Oct. 9, 1998

[51] Int. Cl.[7] ..... B25B 13/50

[52] U.S. Cl. ..... 81/53.2; 81/90.2; 81/90.3

[58] Field of Search ..... 81/53.2, 90.1, 81/90.2, 90.3

[56] References Cited

U.S. PATENT DOCUMENTS

| | | | |
|---|---|---|---|
| 2,550,929 | 5/1951 | Keiser . | |
| 4,724,730 | 2/1988 | Mader et al. | 81/53.2 |
| 4,970,917 | 11/1990 | McCollom | 81/53.2 |
| 5,315,902 | 5/1994 | Ragland et al. | 81/53.2 |

*Primary Examiner*—David A. Scherbel
*Assistant Examiner*—Hadi Shakeri

[57] ABSTRACT

A wrench for removing stud bolts that are damaged in place, lost the bolt head and/or the bolt shank is broken, basically including a socket assembly having a housing with upper and annular walls, a tubular handle assembly and gripping toothed dog members removably mounted inside the socket assembly. The annular wall has an inner cam-shaped surface with cam members inwardly protruded that limit the angular displacement of the gripping toothed dog members when a user actuates the handle assembly. The gripping toothed dog members are arcuate including a plurality of inwardly projected gripping teeth that grasp the exposed surface of the damaged stud bolt when the user pushes and rotates the wrench assembly.

3 Claims, 2 Drawing Sheets

WRENCH FOR REMOVING DAMAGED STUD BOLTS

BACKGROUND OF THE INVENTION

1. Field of the invention.

The present invention is an improved wrench for removing stud bolts, and more particularly, to the type that cannot be removed with a conventional wrench due to their damaged condition.

2. Description of the Related Art.

For many years the users have been facing different difficulties in removing or unscrewing bolts or the like with hand tools, specially, when they are damaged in place, lost the bolt head and/or the bolt shank is broken. For example, the stud bolts that are used in the twin-wheels of trucks are deteriorated due to the external aggressive environment and the operator spends long time and effort trying to remove broken stud bolts aided by any suitable wrench or stud extractor. Those existing wrenches and extractors are expensive to manufacture, consist of numerous parts, complicate mechanisms and are not easily to manipulate where the space to work around the stud bolt is very restricted. Other stud bolt removers cannot work without the impact of an iron maul. The present invention overcomes the shortcomings found in the existing wrenches.

The closest reference found with characteristics similar to the present invention corresponds to U.S. Pat. No. 2,550,929 entitled Ratcheting Stud Wrench and issued in 1949 to J. Keiser. However, it differs from the invention because the patented stud gripping mechanism includes springs 30 and dogs 20 swinging about pins 23. The present invention discloses a wrench having a simple stud bolt gripping mechanism comprising three main parts: handle, socket assembly and gripping toothed dogs. Also, the present invention discloses removable gripping toothed dogs that can be easily replaced with new ones without the need of replacing the entire wrench, as commonly occurs with the existing stud bolt removers. In view that the cost is considerably minimized, this is one of the main advantages of the present invention.

SUMMARY OF THE INVENTION

It is one of the main objects of the present invention to provide a device that permits a user to grip and remove stud bolts that are damaged in place, lost the bolt head and/or the bolt shank is broken.

It is another object of this invention to provide a device that permits a user to unscrew a stud bolt where the space for a conventional wrench to work is very restricted, and where only specific hand tools can be used.

It is still another object of this invention to provide a device that includes removable toothed gripping dogs facilitating the replacement of the latter when the teeth are worn-out without the need of replacing the entire wrench assembly.

It is yet another object of this invention to provide such a device that is less costly to manufacture and maintain while retaining its effectiveness.

Further objects of this invention will be brought out in the following part of the specifications, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
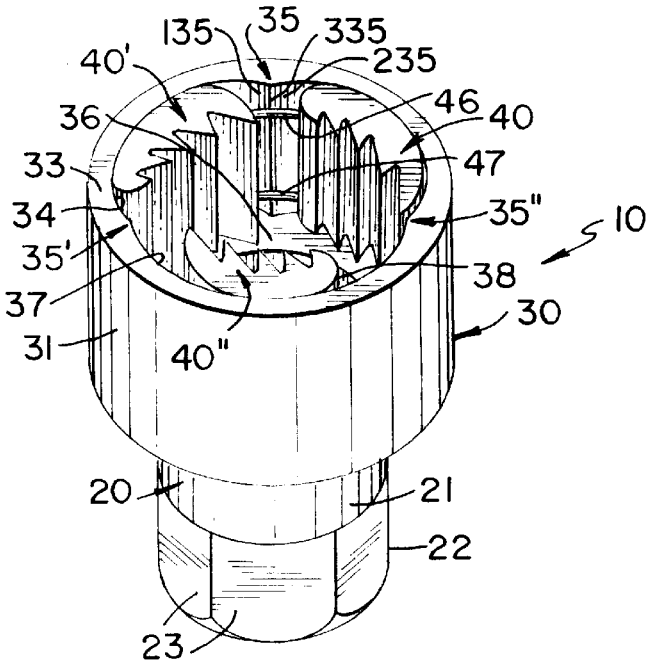
FIG. 1 is a tilted view from the top of the present invention.
Figure 8:
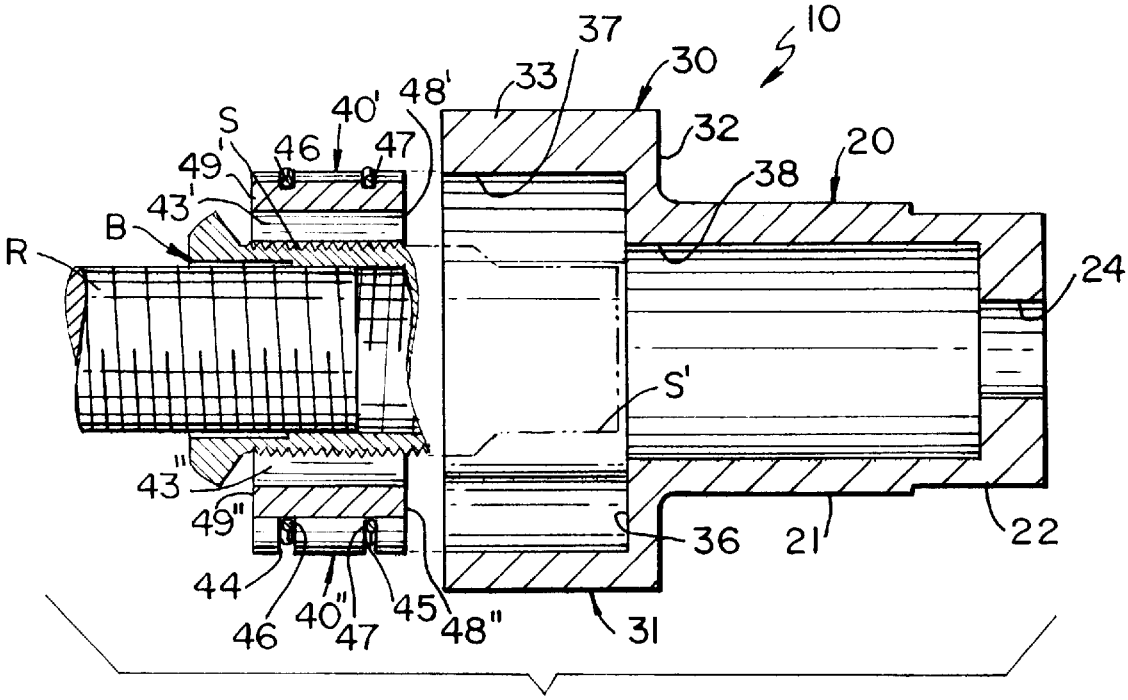
FIG. 8 is an exploded cross-sectional view of the socket assembly and gripping toothed dogs mounted around stud bolt B, taken along line 8—8 in FIG. 2.

As illustrated in FIGS. 1 and 8, stud bolt wrench assembly basically includes tubular handle assembly 20 perpendicularly mounted to socket assembly 30 and gripping toothed dogs 40, 40' and 40" removably mounted inside socket assembly 30.

Tubular handle assembly 20, in the preferred embodiment, includes tubular member 21 rigidly and perpendicularly mounted, at one end, to upper wall 32 of socket assembly 30, as best seen in FIG. 8. Tubular member 21 has, at the other end, wrench-engaging member 22. Wrench engaging member 22 has a plurality of engaging faces 23 that are disposed in such manner that a conventional wrench engages them to actuate stud bolt wrench assembly 10 and stud bolt B. Central through opening 24 permits a user to insert a suitable hand tool and remove stud bolt B from inside wrench assembly 10, in the event stud bolt B is locked in place.

Figure 2:
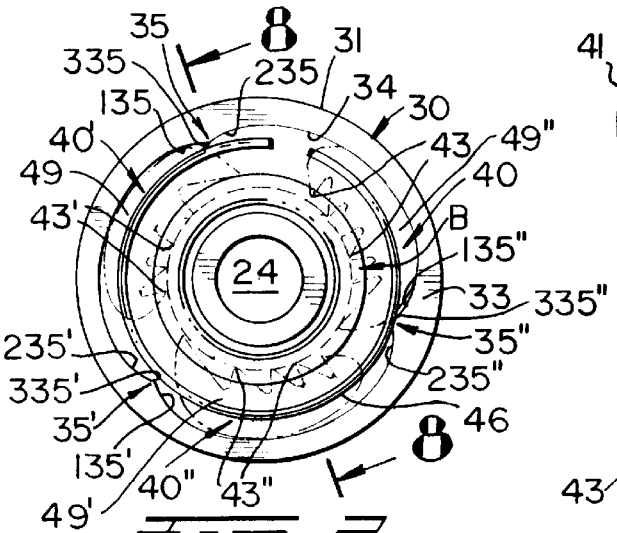
FIG. 2 is a top view of this invention, showing in phantom gripping toothed dogs mounted around a stud bolt B.
Figure 4:
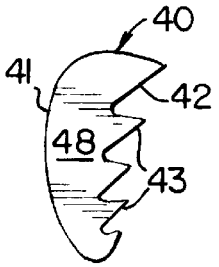
FIG. 4 is a side elevational view of the gripping toothed dog shown in the previous figure.
Figure 5:
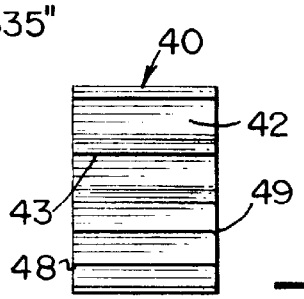
FIG. 5 is a front elevational view of the gripping toothed dog shown in FIGS. 3 and 4.

Socket assembly 30 includes housing 31 with upper wall 32 and annular wall 33. Annular wall 33, in the preferred embodiment, and has inner cam-shaped surface 34. Inner surface 34 has cam members 35; 35' and 35" that are radially and inwardly protruded, as best seen in FIGS. 1 and 2. Cam members 35; 35' and 35" are designed to bring gripping toothed dogs 40, 40' and 40" against the exposed surface of stud bolt B, when housing 31 is rotated. Socket assembly 30 also includes outer opening 37 and inner opening 38. Inner opening 38, as illustrated in FIG. 8, defines the boundary of tubular member 21. Outer and inner openings 37 and 38 allow stud bolt shank S to be inserted through and placed inside housing 31 and tubular member 21 if shank S is long enough (see shank S').

Cam member 35, in the preferred embodiment, has a horned shape having sides 135 and 235, and edge 335, as illustrated in FIG. 2. Cam members 35' and 35" are similar to cam member 35. Cam members 35' and 35" includes curved sides 135'; 235'; 135"; 235" and edges 335' and 335", respectively.

Figure 3:
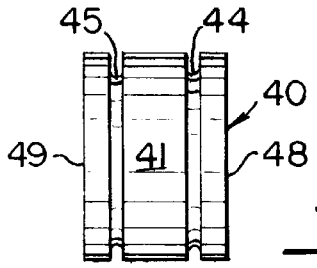
FIG. 3 is a rear elevational view of a gripping toothed dog.
Figure 6:
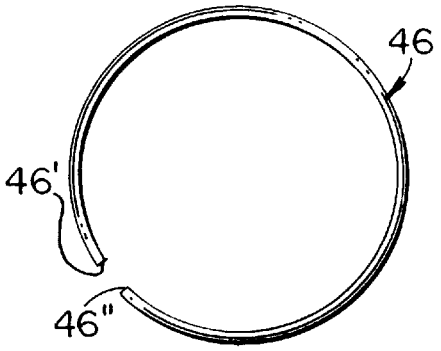
FIG. 6 is a top view of a resilient snap ring.
Figure 7:
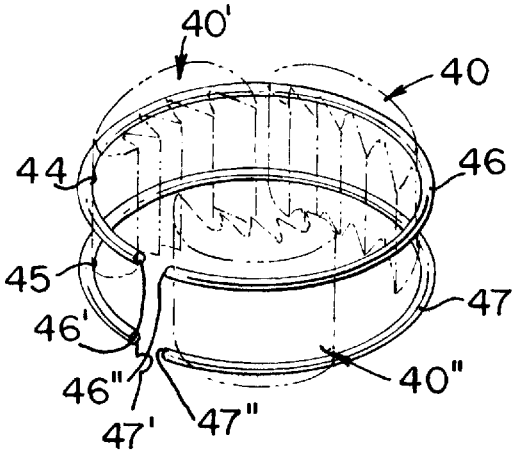
FIG. 7 is a tilted view of resilient snap rings mounted around the gripping toothed dogs. The gripping toothed dogs are shown in phantom.

Referring now to FIGS. 1 through 5, gripping toothed dogs 40, 40' and 40" are similar and have the same functional purpose. Dog member 40 has an arcuate configuration that in combination with cam-shaped inner surface 34 provide a "cam effect" inside housing, as illustrated in FIG. 2. Dog member 40, in the preferred embodiment, has outer convex surface 41 and inner concave toothed surface 42. Convex surface 41 of dog member 40 is resiliently biased toward cam-shaped inner surface 34 of housing 31. A plurality of teeth 43 of concave toothed surface 42 are brought in contact with the exposed surface of stud bolt B gripping the later. Convex surface 41 allows dog member 40 to slide along inner surface 34. Cam member 35; 35' and 35" limit the angular displacement of dog members 40; 40' and 40". Convex surface 41 has grooves 44 and 45 located along the length of dog member 40, as illustrated in FIG. 3. Grooves 44 and 45 are disposed at a spaced apart and parallel relationship to each other, and are designed to cooperatively receive resilient snap rings 46 and 47, respectively. As shown in FIGS. 6 and 7, snap rings 46 and 47 have ends 46'; 46"; 47' and 47" that allow to adjust dog members 40; 40' and 40" to different diameters of stud bolt B. Snap rings 46 and 47, in the preferred embodiment, are intended to retain gripping toothed dogs 40; 40' and 40" in place around stud bolt B. Dog member 40 also includes lateral flat surfaces 48 and 49.

OPERATING METHOD

When a stud bolt, that is commonly used to keep together the twin wheels in tractor trailer combination, is damaged in place and cannot be removed or unscrewed, a user places gripping toothed dogs 40; 40' and 40" (along with rings 46 and 47) around the exposed surface or bolt shank S. Then, socket assembly 30 is placed over gripping toothed dogs 40; 40' and 40". Gripping toothed dogs 40; 40' and 40", in the preferred embodiment, are substantially loosely disposed inside housing 31.

The user actuates tubular handle assembly 20 by pushing socket assembly 30 and bringing step 36 in contact with lateral flat surfaces 48; 48' and 48". When stud bolt wrench assembly 10 is rotated in the direction stud bolt B needs to be unscrewed from threaded rod R, cam members 35; 35' and 35" force gripping toothed dogs 40; 40' and 40" into pressure engagement with the outer surface of stud bolt B or bolt shank S. FIG. 2 illustrates when side 235 of cam member 35 pushes dog member 40, in clockwise direction, toward side 135" of cam member 35". In turn, side 235" pushes dog 40" and side 235' pushes dog 40' toward side 135 of cam member 35. Dog members 40; 40' and 40" simultaneously move. Once dog members 40; 40" and 40' reach curved sides 135"; 135' and 135, respectively, the former are inwardly forced toward bolt B and teeth 43; 43' and 43" firmly grip shank S of bolt B. The relative movement between gripping toothed dogs 40; 40' and 40" and annular wall 33 brings the formers to a position with respect to annular wall 33 where the cross sectional diameter is smaller than the point normally occupied by dogs 40; 40' and 40". The pressure applied at teeth 43; 43' and 43" and the gripping surface of bolt B increases with the torque applied to handle 20 and socket assembly 30, until damaged stud bolt B is firmly secured by wrench 10.

Finally, by means of any suitable wrench placed upon wrench-engaging member 22, damaged stud bolt B can be easily removed from its place.

Should reverse motion be required, wrench assembly 10 can be taken off and reassembled gripping toothed dogs 40; 40' and 40" in the opposite position with lateral flat surfaces 49; 49' and 49" facing step 36 inside housing 31.

The foregoing description conveys the best understanding of the objectives and advantages of the present invention. Different embodiments may be made of the inventive concept of this invention. It is to be understood that all matter disclosed herein is to be interpreted merely as illustrative, and not in limiting sense.

What is claimed is:

1. A wrench for removing stud bolts that are damaged in place such as lost the bolt head, bolt shank is broken, comprising:

a socket assembly having a housing with upper and annular walls defining inner and outer openings through which the damaged stud bolt is placed and wherein said annular wall has an inner cam-shaped surface with at least two cam members inwardly protruded and each of said cam members are defined by two curved sides ending in an edge;

a tubular handle assembly perpendicularly mounted to said socket assembly and wherein said tubular handle assembly includes a tubular member rigidly and perpendicularly mounted, at one end, to said upper wall and a wrench-engaging member, at the other end, and wherein said wrench engaging member has a plurality of engaging faces that are disposed in such manner that a conventional wrench engages them to actuate said stud bolt wrench and said damaged stud bolt, at least two gripping toothed dog members removably mounted inside said housing of said socket assembly and said gripping toothed dog members have an arcuate configuration with outer convex surface and inner concave toothed surface, said gripping toothed dog members having an angular displacement along said inner surface, and wherein said concave surface of said dog member is biased toward said cam-shaped inner surface of said housing when a user actuates said handle and socket assemblies, and wherein the angular displacement of said dog members are limited by said curved sides and the edge of said cam member and wherein said concave toothed surface has a plurality of gripping teeth which are brought in contact with the exposed surface of said damaged stud bolt and firmly grip said exposed surface when a user actuates said handle and socket assemblies and an angular displacement occurs.

2. The wrench set forth in claim 1 wherein said gripping toothed dog members have at least one groove located along the length of said outer convex surface.

3. The wrench set forth in claim 2 further comprising:

at least one resilient snap ring to be placed inside said groove that permits said gripping toothed dog members to be kept in place around said damaged stud bolt.

* * * * *